US007006648B2

(12) United States Patent
Wang

(10) Patent No.: US 7,006,648 B2
(45) Date of Patent: Feb. 28, 2006

(54) SPEAKER CABINET WITH INCREASED AIR CIRCULATION EFFICIENCY

(76) Inventor: Chao-Lang Wang, 3rd Floor, No. 12, Lane 91, Shi-Tung Road, Shih-Lin Dist., Taipei (TW)

( * ) Notice: Subject to any disclaimer, the term of this patent is extended or adjusted under 35 U.S.C. 154(b) by 285 days.

(21) Appl. No.: 10/689,704

(22) Filed: Oct. 22, 2003

(65) Prior Publication Data

US 2005/0089184 A1 Apr. 28, 2005

(51) Int. Cl.
*H04R 25/00* (2006.01)

(52) U.S. Cl. ..... 381/336; 381/345; 181/153

(58) Field of Classification Search ..... 381/306, 381/333, 336, 345, 165; 181/148, 153, 198
See application file for complete search history.

(56) References Cited

U.S. PATENT DOCUMENTS

| | | | | |
|---|---|---|---|---|
| 5,119,429 | A * | 6/1992 | Chatelain | 381/336 |
| 5,361,380 | A * | 11/1994 | You et al. | 181/153 |
| 6,385,324 | B1 * | 5/2002 | Koppen | 381/336 |
| 6,603,862 | B1 * | 8/2003 | Betts | 381/336 |
| 6,628,797 | B1 * | 9/2003 | Yamada | 381/336 |
| 6,705,426 | B1 * | 3/2004 | Copetti | 181/153 |

* cited by examiner

*Primary Examiner*—Suhan Ni
(74) *Attorney, Agent, or Firm*—Bacon & Thomas, PLLC

(57) ABSTRACT

The present invention is to provide a speaker cabinet comprising a hollow case in which a top and a bottom thereof both are wavily tapered from a pair of opposite edges of a front opening to a rear thereof. By utilizing the wavy, rearward taper design of the top and the bottom, a ratio of an area of the opening to an area of the rear is increased. Thus, air inside the case will be compressed rearward when a diaphragm of a woofer vibrates. Next, the compressed air will quickly flow toward the rear along the wavy, rearward taper inner surfaces of the top and the bottom. As a result, air dynamic at the rear is higher and stronger low-frequency resonance of the cabinet can be generated.

10 Claims, 4 Drawing Sheets

SPEAKER CABINET WITH INCREASED AIR CIRCULATION EFFICIENCY

FIELD OF THE INVENTION

The present invention relates to speaker construction and more particularly to an improved speaker cabinet with increased air circulation efficiency.

BACKGROUND OF THE INVENTION

A conventional speaker cabinet 10 is illustrated in FIG. 1. As shown, the speaker cabinet 10 comprises a substantially parallelepiped, hollow case 11 and a cover 12. The hollow case 11 comprises a front opening 110, a top 111, a bottom 111, and a rear 112 in which the top 111 and the bottom 111 are obliquely tapered from a pair of opposite edges of the opening 110 to the rear 112. Two sides 113 of the hollow case 11 are also extended parallel from another pair of opposite edges of the opening 110 to the rear 112. A U-shaped bracket 16 is pivotal about the sides 113 proximate the rear 112. The U-shaped bracket 16 is used to fasten at a predetermined place. A sound control circuit 13 is provided on the inner surface of the rear 112 within the hollow case 11. The sound control circuit 13 is used to receive audio signals from an amplifier of a sound reproducing device (not shown) and control the same. On the cover 12 there are provided a woofer 120, a tweeter 121, and at least one low-frequency sound reflection channel (one is shown) 122. The cover 12 is shaped to snugly fit on the edges of the opening 110. Hence, audio signals of high and low frequencies generated by the sound control circuit 13 are capable of sending to the woofer 120 and the tweeter 121 respectively. The diaphragms of the woofer 120 and the tweeter 121 are thus vibrated to generate low-frequency sounds and high-frequency sounds respectively. Referring to FIG. 1 again, in the prior speaker cabinet 10 a damping member 14 formed of fabric or foam is provided between the cover 12 and the sound control circuit 13. The damping member 14 is used to absorb vibration of low-frequency sounds for avoiding cables 131 and a power cord 132 of the sound control circuit 13 from generating low-frequency resonance. Otherwise, low-frequency sounds may be interfered. Also, a grille-like dusk cover 15 is provided on the cover 12 for the protection of the woofer 120 and the tweeter 121 and is used to prevent dust and other tiny, foreign objects from entering into the speaker cabinet 10.

Referring to FIG. 2, note particularly that in the prior speaker cabinet 10, as stated above, the top 111 and the bottom 111 of the hollow case 11 are obliquely tapered from a pair of opposite edges of the opening 110 to the rear 112. Such design aims at generating an instantaneous vibration on the diaphragm 1201 of the woofer 120 and blowing air inside the hollow case 11 along the oblique inner surfaces of the top 111 and the bottom 111 toward the rear 112 by compressing air inside the case 11 rearward as the diaphragm 1201 moves rearward. Following two equations about ideal air are obtained based on fluid mechanics:

$$A_1V_1=A_2V_2, \text{ and}$$

$$P_1V_1=P_2V_2$$

where $A_1$ and $A_2$ are areas of the front containing the opening 110 and the rear 112 of the hollow case 11 respectively, $V_1$ and $V_2$ are flow rates measured at the front containing the opening 110 and the rear 112 of the hollow case 11 respectively when the diaphragm 1201 of the woofer 120 begins to vibrate, and $P_1$ and $P_2$ are air pressures measured at the front containing the opening 110 and the rear 112 of the hollow case 11 respectively when the diaphragm 1201 of the woofer 120 begins to vibrate. The area $A_1$ of the front containing the opening 110 is much larger than the area $A_2$ of the rear 112 since, as stated above, the top 111 and the bottom 111 of the hollow case 11 are obliquely tapered from a pair of opposite edges of the opening 110 to the rear 112. As such, the flow rate $V_2$ at the rear 112 inside the hollow case 11 is much larger than the flow rate $V_1$ at the opening 110 when the diaphragm 1201 of the woofer 120 vibrates through the application of the above equations. As a result, air dynamic at the rear 112 inside the hollow case 11 is higher.

While higher air dynamic can be obtained at the rear 112 inside the hollow case 11 and also stronger low-frequency resonance of the speaker can be generated when the diaphragm 1201 of the woofer 120 vibrates due to the oblique, taper design of the top 111 and the bottom 111. Also, the top 111 and the bottom 111 of the hollow case 11 are obliquely tapered from a pair of opposite edges of the opening 110 to the rear 112. As such, air, flowed from the front to the rear 112 along the oblique inner surfaces of the top 111 and the bottom 111, may flow back toward the opening 110 when it hits the rear 112 due to the compressibility of air. This is not desired since it may adversely affect the vibration of the diaphragm 1201 of the woofer 120. For solving this problem, at least one low-frequency sounds reflection channel 122 is provided on the cover 12 (or on the rear 112) as best illustrated in the prior speaker cabinet 10 of FIG. 3. The provision of the low-frequency sounds reflection channel 122 is adapted to exit the flowed back air toward the outside.

However, the prior design suffered a disadvantage. In detail, as stated above, the top 111 and the bottom 111 are obliquely tapered from a pair of opposite edges of the opening 110 to the rear 112. Also, two sides 113 of the hollow case 11 are extended parallel from another pair of opposite edges of the opening 110 to the rear 112. That is, four sides 111 and 113 are extended to the rear 112. As such, most air will flow back from the rear 112 to the cover 12 along the same route only a small portion thereof exits from the low-frequency sounds reflection channel 122. The former will cause an adverse vibration of the cover 12, adversely affect the diaphragm 1201 of the woofer 120, and cause distortion in the low-frequency sound. In view of the above, the need for improvement with respect to both quality and volume of low-frequency sounds output of the prior speaker cabinet still exists.

SUMMARY OF THE INVENTION

One object of the present invention is to provide a speaker cabinet comprising a hollow case in which a top and a bottom thereof both are wavily tapered from a pair of opposite edges of a front opening to a rear thereof. By utilizing the wavy, rearward taper design of the top and the bottom, a ratio of an area of the opening to an area of the rear is increased. Thus, air inside the case will be compressed rearward when a diaphragm of a woofer vibrates. Next, the compressed air will quickly flow toward the rear along the wavy, rearward taper inner surfaces of the top and the bottom. As a result, air dynamic at the rear is higher and stronger low-frequency resonance of the cabinet can be generated. Moreover, air may flow back to the opening when it hits the rear. Advantageously, most air will flow back from the rear to at least one low-frequency sounds reflection channel on the cover along the wavy, rearward taper inner surfaces of the top and the bottom prior to exit. This can facilitate air circulation through the case and significantly reduce a probability of secondary reflection of sound wave.

Another object of the present invention is to provide a speaker cabinet in which two sides of the case are extended parallel from another pair of opposite edges of the opening to the rear. Two arcuate (or inclined) surfaces of the rear proximate the sides are formed integrally with the sides. By configuring a rearward taper shape of the rear, air inside the case will be compressed rearward when the diaphragm of the woofer vibrates. Further, the compressed air with high dynamic will flow quickly toward the rear to concentrate on the inner surface of the rear corresponding to the low-frequency sounds reflection channel. Thereafter, air flowed back from the rear toward the opening will be highly concentrated on the low-frequency sounds reflection channel prior to freely exiting therefrom. By utilizing the present invention, adverse effect on the vibration of the diaphragm of the woofer caused by the compressed air and vacuum suck effect inside the case will be substantially eliminated, and distortion in the low-frequency sounds is much improved.

Still another object of the present invention is to provide a speaker cabinet in which by utilizing the wavy, rearward taper shapes of the top and the bottom, air inside the case will be compressed rearward to concentrate on the inner surface of the rear corresponding to the rears of the low-frequency sounds reflection channel when the diaphragm of the woofer vibrates prior to exiting from the low-frequency sounds reflection channel. Alternatively, by utilizing the vacuum suck effect inside the case, outside air will be introduced into the case through the low-frequency sounds reflection channel. By utilizing the present invention, adverse effect on the vibration of the diaphragm of the woofer caused by the compressed air and vacuum suck effect inside the case will be substantially eliminated, and both quality and volume of low-frequency sounds output of the woofer are much increased.

The above and other objects, features and advantages of the present invention will become apparent from the following detailed description taken with the accompanying drawings.

DETAILED DESCRIPTION OF THE PREFERRED EMBODIMENTS

Figure 1:
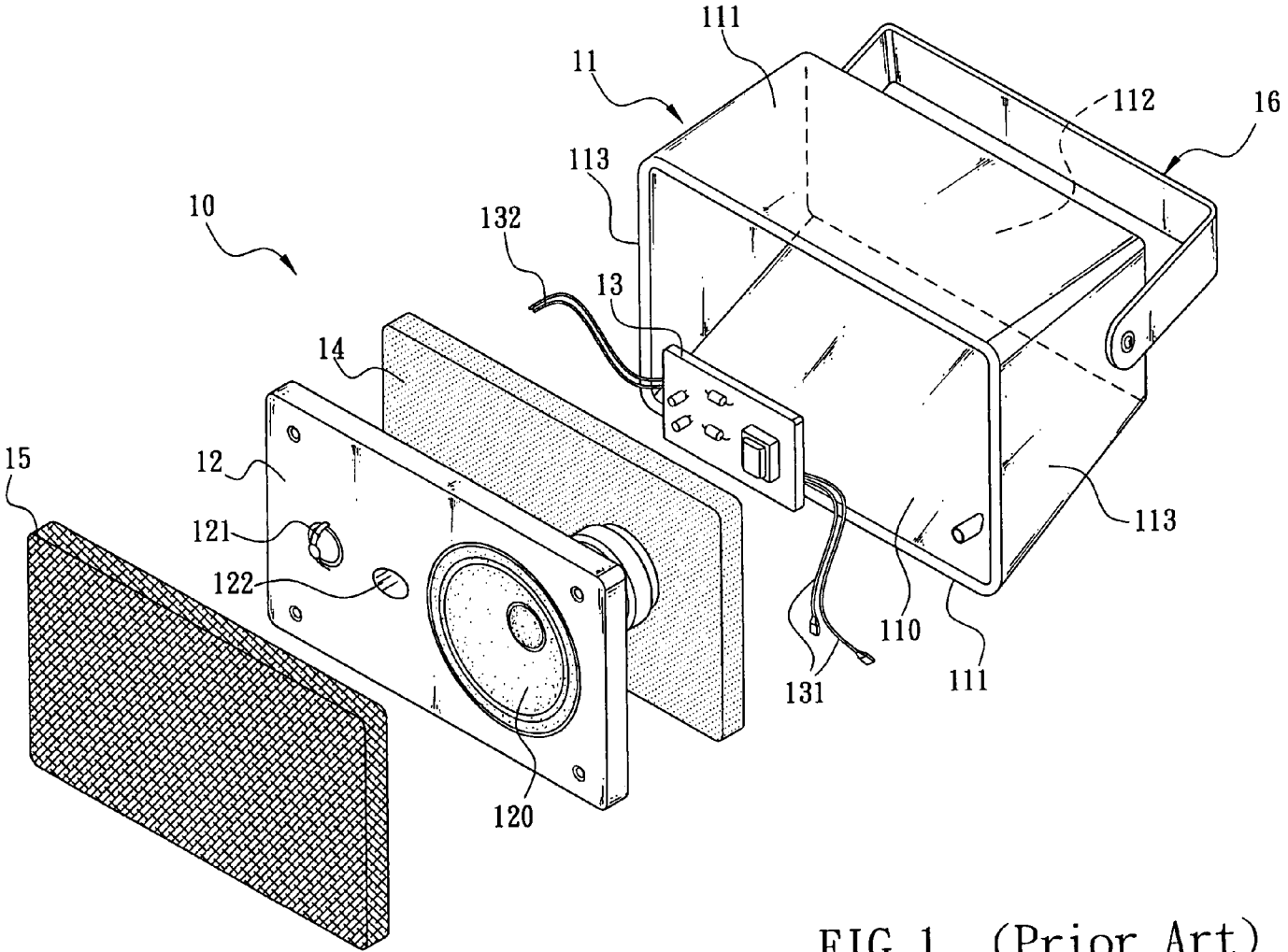
FIG. 1 (Prior Art)
FIG. 1 is an exploded view of a conventional speaker cabinet.
Figure 2:
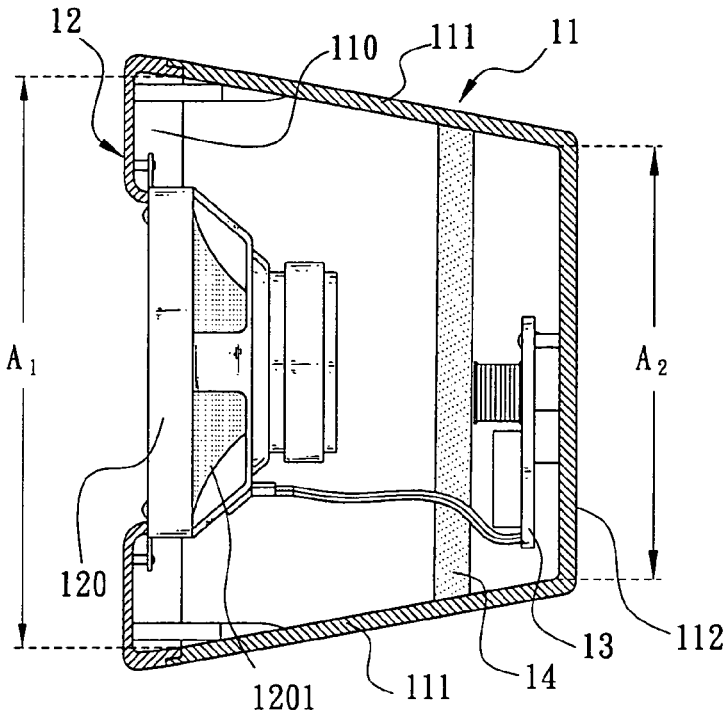
FIG. 2 (Prior Art)
FIG. 2 is a transverse, cross-sectional view of the assembled speaker cabinet.
Figure 3:
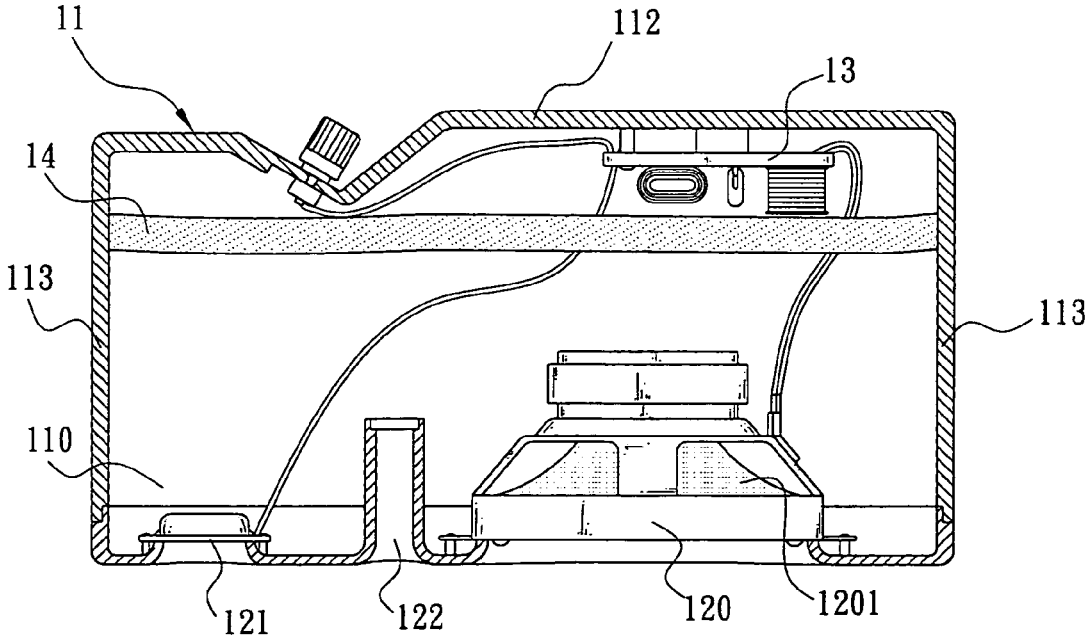
FIG. 3 (Prior Art)
FIG. 3 is a longitudinal, cross-sectional view of the assembled speaker cabinet.
Figure 4:
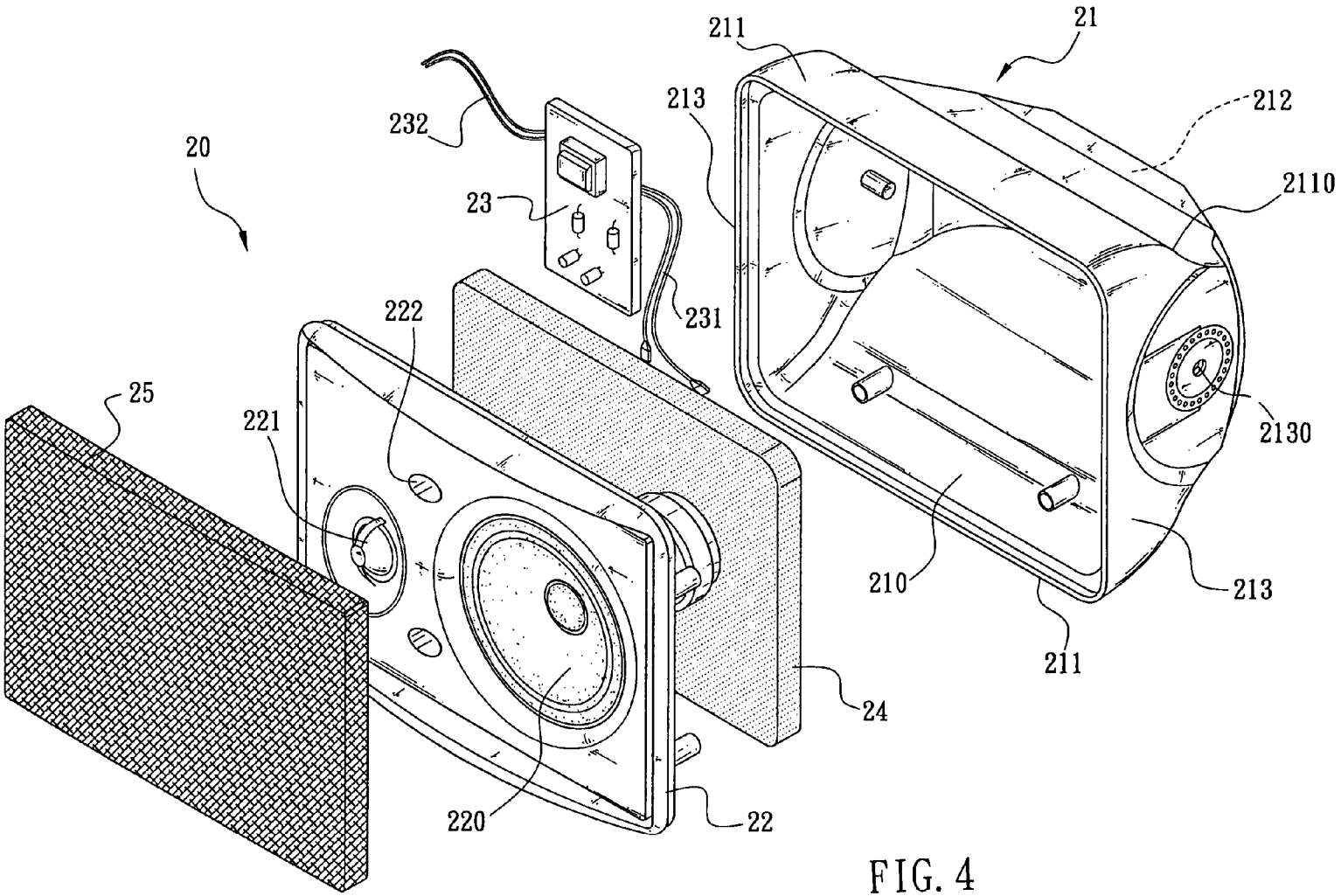
FIG. 4 is an exploded view of a preferred embodiment of speaker cabinet according to the invention.

Referring to FIG. 4, there is shown a speaker cabinet 20 with increased air circulation efficiency in accordance with the invention. As shown, the speaker cabinet 20 comprises a hollow case 21 and a cover 22. The hollow case 21 comprises a front opening 210, a wavy top 211, a wavy bottom 211, and a rear 212 in which the top 211 and the bottom 211 are wavily tapered from a pair of opposite edges of the opening 210 to the rear 212. Two sides 213 of the hollow case 21 are also extended parallel from another pair of opposite edges of the opening 210 to the rear 212. In other words, the area of the rear 212 is smaller than that of the opening 210. A pivot hole 2130 is provided at either side 213 proximate the rear 212. A bracket (not shown) can be provided at the pivot holes 2130 for fastening the hollow case 21 at a predetermined place. A sound control circuit 23 is provided on the inner surface of the rear 212 within the hollow case 21. The sound control circuit 23 is used to receive audio signals from an amplifier of a sound reproducing device (not shown) and control the same. On the cover 22 there are provided a woofer 220, a tweeter 221, and at least one low-frequency sounds reflection channel (two are shown) 222. The cover 22 is shaped to snugly fit on the edges of the opening 210. Hence, audio signals of high and low frequencies generated by the sound control circuit 23 are capable of sending to the woofer 220 and the tweeter 221 respectively. The diaphragms of the woofer 220 and the tweeter 221 are thus vibrated to generate low-frequency sounds and high-frequency sounds respectively.

Referring to FIG. 4 again, in the speaker cabinet 20 of the invention a damping member 24 formed of fabric or foam is provided between the cover 22 and the sound control circuit 23 on the inner surface of the rear 212. The damping member 24 is used to absorb vibration of low-frequency sounds for avoiding cables 231 and a power cord 232 of the sound control circuit 23 from generating low-frequency resonance. Otherwise, low-frequency sounds may be interfered. Also, a grille-like dusk cover 25 is provided on the cover 22 for the protection of the woofer 220 and the tweeter 221 and is used to prevent dust and other tiny, foreign objects from entering into the speaker cabinet 20.

Figure 5:
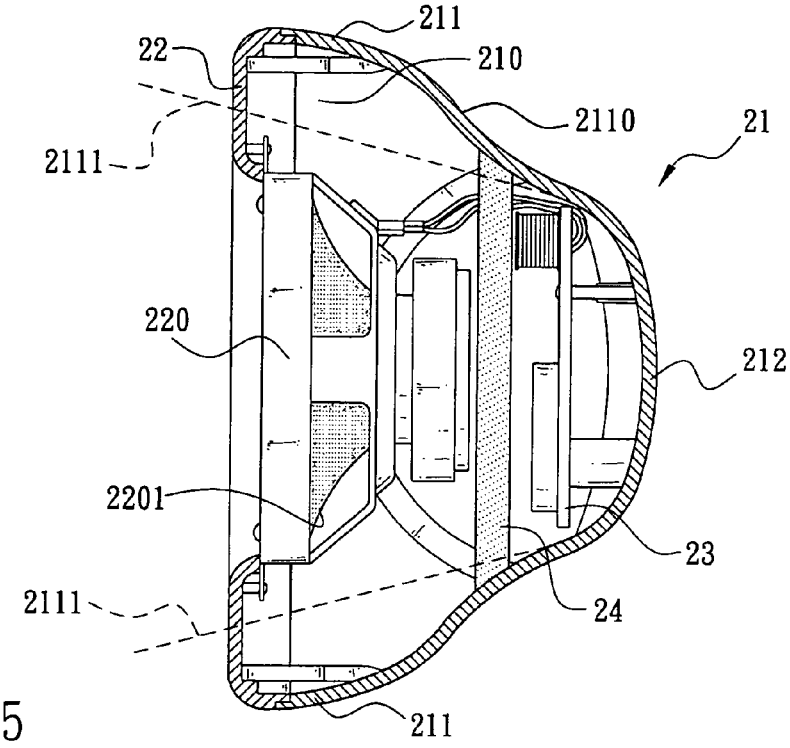
FIG. 5 is a transverse, cross-sectional view of the assembled speaker cabinet shown in FIG. 4.

In the invention the wavy top 211 and the wavy bottom 211 of the hollow case 21 are designed to wavily taper from a pair of opposite edges of the opening 210 to the rear 212. As shown in FIGS. 4 and 5, in a preferred embodiment of the invention the top 211 and the bottom 211 are arcuate having two wavy sections in which one wavy section proximate the opening 210 curves inwardly about the hollow case 21 and the other wavy section proximate the rear 212 curves outwardly about the hollow case 21. Hence, a continuous curve 2110 consisting of the wavy sections is formed. By utilizing the wavy, rearward taper design of the wavy top 211 and the wavy bottom 211 of the invention, a ratio of the area of the opening 210 to the area of the rear 212 is higher than that of the prior speaker cabinet in terms of the same depth of the hollow case 21. Air inside the hollow case 21 will be compressed rearward when the diaphragm 2201 of the woofer 220 vibrates (i.e., the diaphragm 2201 moves rearward). As such, the compressed air will quickly flow toward the rear 212 along the wavy, rearward taper inner surfaces of the wavy top 211 and the wavy bottom 211. As a result, air dynamic at the rear 212 is higher and stronger low-frequency resonance of the speaker cabinet 20 can be generated. Moreover, note particularly that air, flowed from the opening 210 to the rear 212 along the wavy, rearward taper inner surfaces of the top 211 and the bottom 211, may flow back toward the opening 210 when it hits the rear 212. Advantageously, most air will flow back from the rear 212 to the rears of the low-frequency sounds reflection channels 222 on the cover 22 along a tangent 2111 of the continuous curve 2110 prior to exit because the top 211 and the bottom 211 proximate the rear 212 are curved outwardly toward the hollow case 21.

The preferred embodiment of the invention has been described in FIGS. 4 and 5, while it is appreciated by those skilled in the art that each of the top 211 and the bottom 211 may have at least one wavy section in any other embodiment as long as a portion thereof proximate the rear 212 is curved outwardly toward the hollow case 21 for forming a wavy, rearward taper shape without departing from the scope and spirit of the invention. This has the advantages of causing the ratio of the area of the opening 210 to the area of the rear 212 to be higher than that of the prior speaker cabinet in terms of the same depth of the hollow case 21. Also, most air will flow back from the rear 212 to the rears of the low-frequency sounds reflection channels 222 on the cover 22 (i.e., toward the opening 210) along the tangent 2111 of the continuous curve 2110 after hitting the rear 212. All of the above changes are contemplated by the invention.

Figure 6:
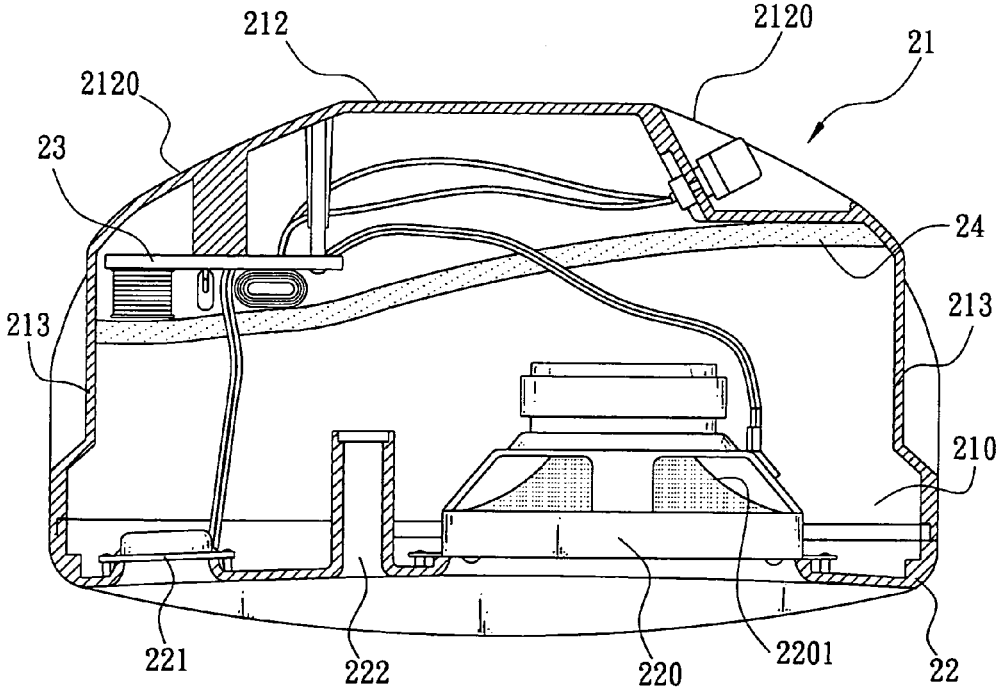
FIG. 6 is a longitudinal, cross-sectional view of the assembled speaker cabinet shown in FIG. 4.

Referring to FIG. 6 in conjunction with FIG. 4, in the preferred embodiment of the invention two sides 213 of the hollow case 21 are extended parallel from another pair of opposite edges of the opening 210 to the rear 212. Two arcuate (or inclined) surfaces 2120 of the rear 212 proximate the sides 213 are formed integrally with the sides 213. In the preferred embodiment, the surfaces 2120 are curved inwardly toward the hollow case 21, resulting in a rearward taper shape of the rear 212. By configuring as above, air inside the hollow case 21 will be compressed rearward when the diaphragm 2201 of the woofer 220 vibrates. As such, the compressed air will flow quickly toward the rear 212. That is, air dynamic at the rear 212 is higher. Also, the compressed air is concentrated on the inner surface of the rear 212 corresponding to the low-frequency sounds reflection channels 222. Thereafter, air flowed back from the rear 212 toward the opening 210 will be highly concentrated on the rears of the low-frequency sounds reflection channels 222. As a result, the flowed back air is free to exit from the low-frequency sounds reflection channels 222.

In view of the above, in the speaker cabinet 20 of the invention by utilizing the wavy, rearward taper design of the top 211 and the bottom 211, air inside the hollow case 21 will be compressed rearward to concentrate on the inner surface of the rear 212 corresponding to the rears of the low-frequency sounds reflection channels 222 when the diaphragm 2201 of the woofer 220 vibrates. Eventually, air exits from the low-frequency sounds reflection channels 222. Alternatively, by utilizing the vacuum sucking effect inside the hollow case 21, outside air will be introduced into the hollow case 21 through the low-frequency sounds reflection channels 222 when the diaphragm 2201 moves forward. By utilizing the invention, air circulation through the hollow case 21 is more smooth, probability of secondary reflection of sound wave is significantly reduced, adverse effect on the vibration of the diaphragm 2201 of the woofer 220 caused by the compressed air and vacuum sucking effect inside the hollow case 21 will be substantially eliminated, distortion in the low-frequency sounds is much improved, and both quality and volume of low-frequency sounds output of the woofer are much increased.

While the invention has been described by means of specific embodiments, numerous modifications and variations could be made thereto by those skilled in the art without departing from the scope and spirit of the invention set forth in the claims.

What is claimed is:

1. A speaker cabinet with an increased air circulation efficiency, comprising:

a hollow case including a front opening, a rear having a rearward taper surface, a top and a bottom both wavily tapered from a pair of opposite edges of the opening to the rear, and two sides extended parallel from another pair of opposite edges of the opening to the rear;

a sound control circuit on an inner surface of the rear for receiving audio signals from an external device and controlling the same;

a cover shaped to fit on the edges of the opening;

at least one woofer on the cover for receiving audio signals of low-frequency generated by the sound control circuit and vibrating a diaphragm thereof for generating low-frequency sounds; and at least one low-frequency sounds reflection channel on the cover corresponding to a central portion of the rear.

2. The speaker cabinet of claim 1, wherein each of the top and the bottom is comprised of at least one wavy surface.

3. The speaker cabinet of claim 2, wherein one wavy surface of each of the top and the bottom proximate the rear is curved outwardly about the case.

4. The speaker cabinet of claim 3, wherein the other wavy surface of each of the top and the bottom proximate the opening is curved inwardly about the case.

5. The speaker cabinet of claim 4, wherein a continuous curve is formed of two wavy surfaces of each of the top and the bottom so that a wavy, rearward taper shape of each of the top and the bottom is formed.

6. The speaker cabinet of claim 3, wherein the rear includes two inclined surfaces proximate the sides being formed integrally with the sides.

7. The speaker cabinet of claim 3, wherein the rear includes two arcuate surfaces proximate the sides being formed integrally with the sides.

8. The speaker cabinet of claim 7, wherein the arcuate surfaces of the rear proximate the sides are curved inwardly toward the case so that a rearward taper shape of the rear is formed.

9. The speaker cabinet of claim 3, further comprising a pivot hole at either side proximate the rear and a bracket pivotably coupled to the pivot holes.

10. The speaker cabinet of claim 3, further comprising a damping member formed of fabric or foam between the cover and the sound control circuit.

* * * * *